United States Patent [19]

Urai et al.

[11] Patent Number: 4,958,394

[45] Date of Patent: Sep. 25, 1990

[54] SEAT CUSHION FOR VEHICLE AND METHOD OF MAKING THE SAME

[75] Inventors: Muneharu Urai; Hiroshi Suzuki, both of Akishima, Japan

[73] Assignee: Tachi-S Co., Ltd., Akishima, Japan

[21] Appl. No.: 60,412

[22] Filed: Jun. 11, 1987

[51] Int. Cl.[5] ..... A47C 25/00

[52] U.S. Cl. ..... 5/475; 5/481

[58] Field of Search ..... 5/481, 477, 475, 263; 297/452, DIG. 1

[56] References Cited

U.S. PATENT DOCUMENTS

| | | | |
|---|---|---|---|
| Re. 24,914 | 12/1960 | Koenigsberg | 5/475 |
| 2,685,329 | 8/1954 | Stubnitz | 5/263 |
| 2,980,167 | 4/1961 | Harris | 5/481 |
| 2,980,168 | 4/1961 | Ross | 297/452 |
| 3,069,701 | 12/1962 | McInerney | 5/481 |
| 3,130,964 | 4/1964 | Johnson | 297/452 |
| 3,142,515 | 7/1964 | Wall | 297/452 |
| 3,252,735 | 5/1966 | Smith | 297/DIG. 1 |
| 3,393,012 | 7/1966 | Chancellor | 297/452 |
| 3,911,511 | 10/1975 | Higgins | 5/475 |
| 4,101,993 | 7/1978 | Yates | 5/263 |

FOREIGN PATENT DOCUMENTS

| | | | |
|---|---|---|---|
| 143473 | 8/1950 | Australia | 5/477 |
| 2655662 | 6/1978 | Fed. Rep. of Germany | 297/DIG. 1 |
| 3221783 | 10/1983 | Fed. Rep. of Germany | 5/263 |
| 1095980 | 12/1967 | United Kingdom . | |

*Primary Examiner*—Ramon O. Ramirez
*Assistant Examiner*—Robert A. Olson
*Attorney, Agent, or Firm*—Oldham & Oldham Co.

[57] ABSTRACT

A seat cushion for a vehicle is made by integrally molding a block of foamed polyurethane and coiled metal spring members. The spring members are disposed in a seat base portion or side portions of the seat cushion where a suitable hardness or repulsive elasticity is required to asist the restoring force of the layer of the foamed polyurethane lying on the spring members.

8 Claims, 4 Drawing Sheets

SEAT CUSHION FOR VEHICLE AND METHOD OF MAKING THE SAME

BACKGROUND OF THE INVENTION

1. Field of the Invention

This invention relates to a seat cushion for use in a vehicle and a method of making the same. More particularly, this invention relates to a vehicle's seat cushion in which the damping characteristic of metal springs is improved, and the state of intimate contact between the metal springs and a block of foamed polyurethane is also improved, so that occupants of the vehicle can feel comfortable to sit on the seats.

2. Description of the Prior Art

A prior art seat cushion for a vehicle will be described with reference to FIGS. 8 and 9, before describing the present invention.

A prior art seat cushion made of foamed polyurethane has a peculiar deflection characteristic as shown in FIG. 8. In FIG. 8, the solid curve and broken curve represent the deflection characteristic of a metal spring and that of foamed polyurethane respectively.

The deflection characteristic of the seat cushion represented by the broken curve is not necessarily satisfactory from the viewpoint of giving a comfortable feeling of sitting. Therefore the elasticity of high elasticity foamed polyurethane is now utilized to compensate the insufficient deflection characteristic of the prior art seat cushion thereby improving the feeling of sitting. However, this effort has not been successful in improving the insufficient deflection characteristic of the prior art seat cushion.

FIG. 9 shows coiled metal spring members 1 assembled according to a prior art practice. The assembling of these spring members 1 has required an extra step resulting in incurrence of an additional cost since many clips (as shown by a numeral 5 in FIG. 6) are used to fasten the spring members 1 to, for example, an upper border wire (not shown). Further, because the spring members 1 shown in FIG. 9 are in contact with each other, rubbing engagement of these spring members with each other at their contact portions generates noise which cannot be eliminated even when a soundproof paint is coated on the spring members.

SUMMARY OF THE INVENTION

With a view to obviate the prior art defects pointed out above, it is an object of the present invention to provide a seat cushion in which coiled metal spring members and a block of foamed polyurethane are integrally molded in such a manner that their merits are uniquely combined together to outweigh the defects thereby ensuring a comfortable feeling of sitting. Another object of the present invention is to provide a method of making such a seat cushion.

In accordance with one aspect of the present invention, there is provided a seat cushion for a vehicle comprising a block of foamed polyurethane and at least one endless coiled spring member formed by coiling a spring metal wire having a small diameter, the spring member being integrally molded in a seat base portion or each of side portions of the seat cushion to provide desired load-deflection characteristics to the seat or a repulsive elasticity to assist the restoring force of the layer of the foamed polyurethane lying on the spring member.

In accordance with another aspect of the present invention, there is provided a method of making a seat cushion for a vehicle comprising integrally molding a block of foamed polyurethane and at least one endless coiled spring member formed by coiling a spring metal wire having a small diameter, the spring member being integrally molded in a seat base portion or each of side portions of the seat cushion where desired load deflection characteristics are obtained or a repulsive elasticity is required so as to assist the restoring force of the layer of the foamed polyurethane the upper surface of which is spaced by a predetermined thickness from the upper surface of the metal spring member.

Thus, when the foamed polyurethane and the spring member having respectively different deflection characteristics as described above are integrally molded together, their deflection characteristics compensate each other, and the sagging tendency of the deflection characteristic of the foamed polyurethane is cancelled to improve the damping characteristic of the metal spring member thereby further improving the occupants' comfortable feeling of sitting.

DESCRIPTION OF THE PREFERRED EMBODIMENTS

Preferred embodiments of the present invention will now be described in detail with reference to FIGS. 1 to 7.

In FIGS. 1 to 7, reference members 1, 2, 3, 4, 5 and 7 designate an endless coiled metal spring member, a block of foamed polyurethane, a lower border wire, a spring retainer, a clip anchoring a portion of the endless metal spring member to the lower border wire, and an upper mold, respectively.

Figure 1:
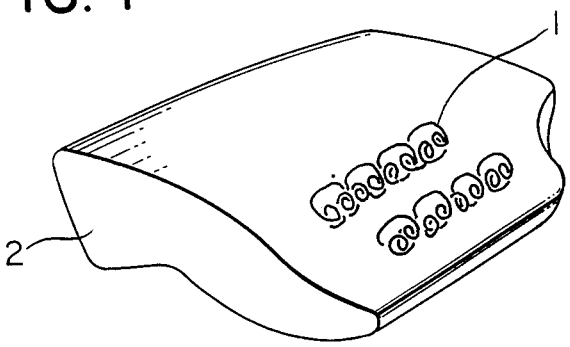
FIGS. 1 to 3 are perspective views of various embodiments of seat cushions of the present invention respectively to show how an endless coiled spring member or members are dispose din a block of foamed polyurehtane.
Figure 2:
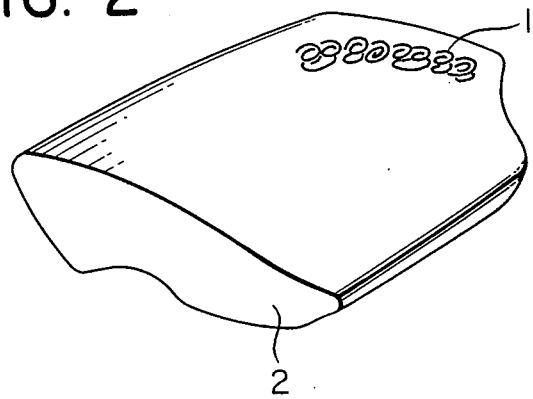
Figure 3:
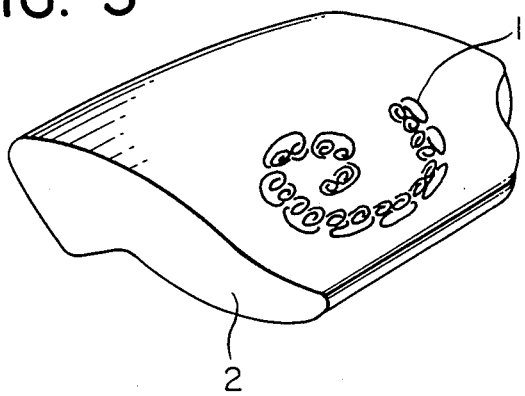
Figure 4:
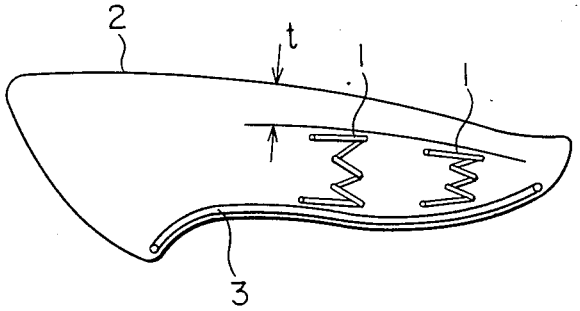
FIG. 4 is a sectional view of an integrally molded seat cushion according to another embodiment of the present invention.
Figure 5:
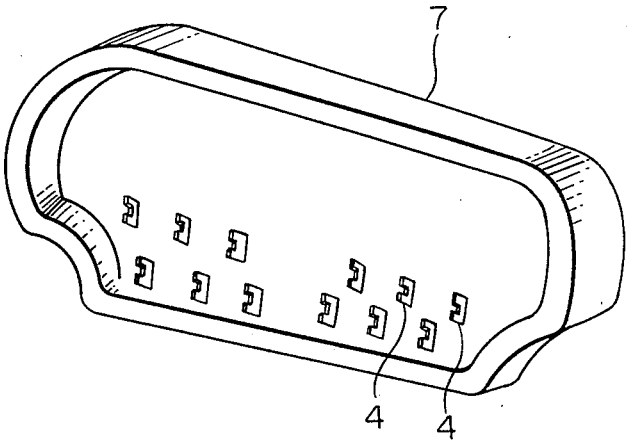
FIG. 5 is a perspective view showing the relation between an upper mold and spring retainers used in another embodiment of the present invention.
Figure 6:
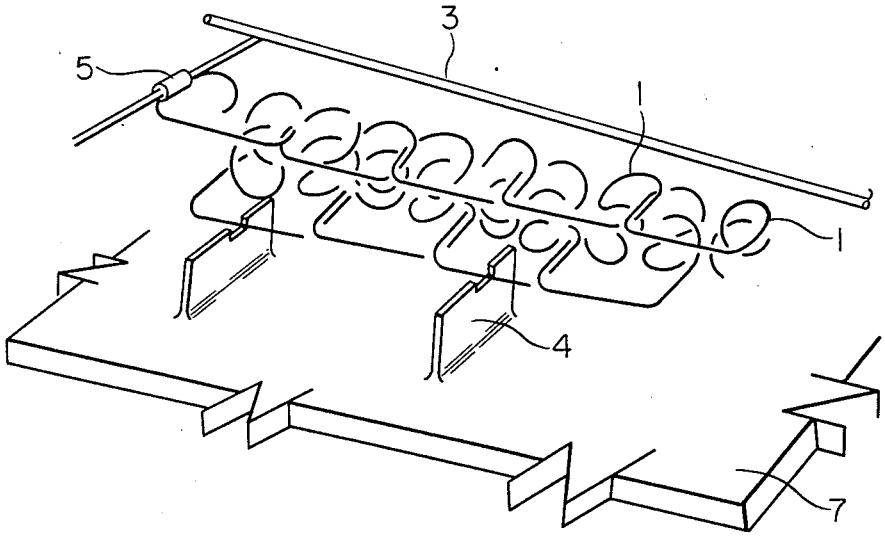
FIG. 6 is a perspective view showing the metal spring member supported on the spring retainers shown in FIG. 5 where the upper mold is in an upside down position.
Figure 7:
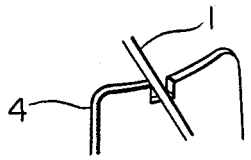
FIG. 7 is a perspective view showing in detail the manner of supporting the metal spring member on the spring retainer shown in FIG. 6.

FIGS. 1 to 3 show arrangements of endless coiled metal spring members 1 in blocks 2 of foamed polyurethane respectively. FIG. 4 is a sectional view of a seat cushion formed by integrally molding a block 2 of foamed polyurethane and endless coiled metal spring members 1. FIG. 5 is a perspective view showing spring retainers 4 and an upper mold 7. FIG. 6 is a perspective view showing endless coiled metal spring members 1 supported on spring retainers 4. FIG. 7 is a perspective view showing in detail the manner of supporting the metal spring member 1 on the spring retainer 4 shown in FIG. 6.

The material of the spring member 1 is, preferably a small-diameter spring steel wire having a spring constant analogous to that of the foamed polyurethane 2, and the spring steel wire is shaped continuously into an endless form by an apparatus designed exclusively for that purpose. The spring retainer 4 is formed with a groove or a recess in its upper part as shown in FIG. 7 to retain the metal spring member 1 in position. This retainer 4 may be a magnet.

In an embodiment of the seat cushion shown in FIG. 1, two endless coiled metal spring members 1 are integrally molded in the seat base portion of the seat cushion of foamed polyurethane 2. In another embodiment of the seat cushion shown in FIG. 2, a single endless coiled metal spring member 1 is integrally molded in each of the side portions contiguous to the seat base portion of the seat cushion of foamed polyurethane 2 although only one of them is shown. In still another embodiment of the seat cushion shown in FIG. 3, a single endless coiled metal spring member 1 is integrally molded in a spiral form in a somewhat rear middle position of the seat base portion of the seat cushion of foamed polyurethane 2. In yet another embodiment of the seat cushion shown in FIG. 4, endless coiled metal spring member 1 is integrally molded in a block 2 of foamed polyurethane in a relation in which the upper surface of the spring members 1 is spaced apart from the upper surface of the block 2 of foamed polyurethane by a predetermined distance or thickness t. FIG. 5 illustrates that spring retainers 4 are disposed in an upper mold prior to the integral molding of the foamed polyurethane 2 and the spring members 1. FIG. 6 illustrates the upper mold in an upside down position for manufacture wherein the spring members 1 will be locally supported on the spring retainers 4. FIG. 7 illustrates in detail that each of the spring retainers 4 has a recess in which the associated spring member 1 is locally received and supported.

The coiled metal spring member 1 is formed by coiling a small-diameter metal wire having a spring constant analogous to that of the foamed polyurethane 2. In order to improve the state of intimate contact between the spring member 1 and the foamed polyurethane 2, the metal wire is preferably subjected to defatting treatment such as cleansing or heat treatment or subjected to sand-blasting, shot-peening or like treatment to roughen its surface.

In FIG. 5, the spring retainers 4 are disposed in the upper mold. However, these spring retainers 4 may be disposed in a lower mold, and the spring members 1 may be mounted in the upper mold.

Figure 8:
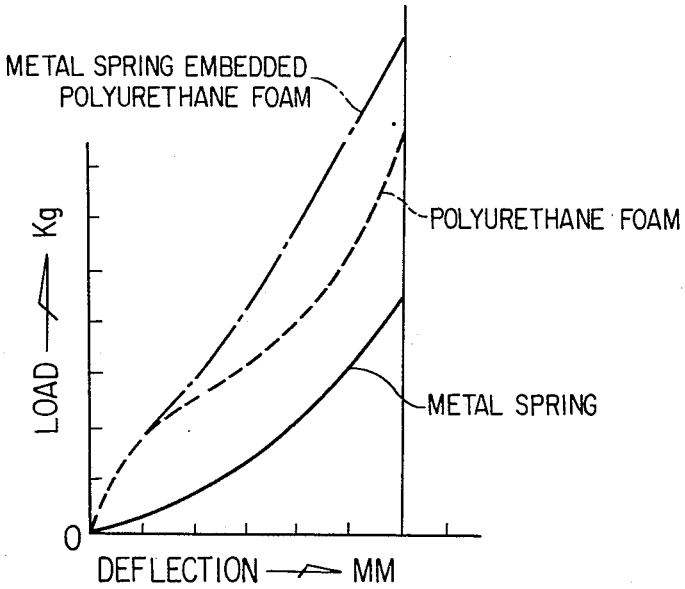
FIG. 8 is a graph showing deflection characteristics of the components of the seat cushion.
Figure 9:
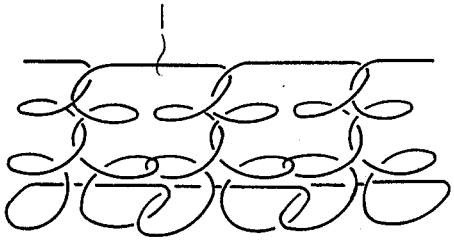
FIG. 9 is a perspective view of spring members used in a prior art seat.

The metal spring member 1 and the foamed polyurethane 2 have respectively different load-deflection characteristics as described already with reference to FIG. 8. The load-deflection characteristic of the foamed polyurethane is such that the deflection is initially small but increases relatively sharply with the increase in the load. On the other hand, the load-deflection characteristic of the metal spring member is such that, although the deflection changes along a gentle curve as shown in FIG. 8, the vibration damping characteristic is not completely satisfactory. Therefore, when the foamed polyurethane 2 and the metal spring member 1 are integrally molded, the sagging tendency of the load-deflection characteristic of the foamed polyurethane is cancelled, and the vibration damping characteristic of the metal spring member is improved, thereby further improving the comfortable feeling of sitting as shown by the one-dot chain curve in FIG. 8.

Further, since the surface smoothness of the metal spring member 1 is almost lost as a result of the defatting, sand-blasting or shot-peening treatment on the metal spring member the foamed polyurethane makes satisfactorily intimate contact with the metal spring member in the integrally molded structure.

Also, since the spring constant of the metal wire forming the metal spring member is analogous to that of the foamed polyurethane, the foamed polyurethane fits well on the metal spring member without any possibility of separation from each other. Further, since the metal spring member is formed by the small-diameter metal wire, an occupant sitting on the seat cushion would not feel strange even when he sits on an area where the metal spring member is present.

Also, the fatigue strength (the resistance against permanent set due to repeated compression) of the seat cushion is remarkably improved.

The metal spring members molded in the foamed polyurethane do not make rubbing contact or make little rubbing contact, if any, because the foamed polyurethane makes intimate contact with the metal spring members. Even when noise of low level may be generated, such noise does not emanate to the exterior of the seat cushion because of the good noise-proofness of the foamed polyurethane, and any preventive means such as a coating of noise-proof paint is unnecessary. Further, since anchoring of the metal spring members by many clips as in the prior art practice is unnecessary, the cost required for such a step can be eliminated.

In the present invention, the foamed polyurethane is combined with the metal spring members, unlike the prior art seat cushion consisting of molded polyurethane foam only. Therefore, when the elasticity of the polyurethane portion need not be high, the specific gravity of the polyurethane portion can be decreased. That is, the cost of the polyurethane can be reduced.

Further, when the seat cushion is made of foamed polyurethane only, an occupant sitting on the seat cushion feels the sense of bottoming because the rate of deflection of the polyurethane in a range close to 100% compression is less than that of the metal spring member. The combination of the foamed polyurethane and the metal spring member reduces the sense of bottoming thereby correspondingly increasing the comfortable feeling of sitting.

We claim:

1. A seat cushion for a vehicle comprising a block of foamed polyurethane having at least a base portion and side portions adjacent said base portion forming an uneven upper surface on said seat cushion being formed in a mold and at least one endless coiled metal spring member being integrally molded in said base portion and each of said side portions by positioning said spring members relative to said mold using spring retainers positioned in said mold, said at least one spring member being positioned at a predetermined distance from said uneven upper surface of said seat cushion at said base portion and each of said side portions by said spring retainers which position said at least one spring member at said predetermined distance during said integral molding of said seat cushion.

2. A seat cushion according to claim 1, wherein, said endless coiled metal spring member has an elasticity relatively analogous to that of said foamed polyurethane, and its surface is previously subjected to defatting treatment.

3. A seat cushion according to claim 1, wherein said spring retainers each have a spring retaining portion and are disposed at necessary positions in an upper mold or a lower mold to retain said metal spring member in position.

4. A seat cushion according to claim 1, wherein, said endless coiled metal spring member is previously subjected to sandblasting or shot-peening treatment.

5. A method of making a seat cushion comprising the steps of integrally molding of block of foamed polyurethane in a mold with at least one endless coiled metal spring member formed by coiling a spring metal wire having a small diameter, said spring member being positioned relative to said mold at the location of a seat base portion or each of side portions of said seat cushion by means of spring retainers disposed relative to said mold and in a position relative to each of said at least one spring member so as to retain said at least one spring member at a predetermined distance from the upper surface of said base portion or each of said side portions of said seat cushion.

6. A method making a seat cushion according to claim 5, wherein said spring retainers each have a spring retaining portion and are disposed at necessary positions in an upper mold or a lower mold to retain said metal spring members in position.

7. A method of making a seat cushion according to claim 5, wherein said spring members are locally supported in said block of foamed polyurethane by means of said spring retainers so as to control the restoring force of said spring member on said upper surface of the seat cushion.

8. A method of making a seat cushion comprising the steps of integrally molding a block of foamed polyurethane and at least one endless coiled metal spring member, said spring member being positioned in a seat base portion or each of side portions of said seat cushion by means of spring retainers which are positioned at a location relative to each of said at least one spring member so as to retain said at least one spring member at a predetermined distance from the upper surface of said seat cushion, wherein said spring member is a magnet and is positioned so as to locally support said spring member and control the restoring force of said spring member on said upper surface of said seat cushion.

* * * * *